United States Patent [19]

Ambasz

[11] 4,084,850

[45] Apr. 18, 1978

[54] CHAIR

[75] Inventor: Emilio Ambasz, New York, N.Y.

[73] Assignee: Center for Design Research and Development N.V., Curacao, Netherlands Antilles

[21] Appl. No.: 721,164

[22] Filed: Sep. 7, 1976

Related U.S. Application Data

[63] Continuation-in-part of Ser. No. 586,794, Jun. 13, 1975, abandoned.

[51] Int. Cl.[2] ..... A47C 1/02

[52] U.S. Cl. ..... 297/317; 297/248; 297/300; 297/306; 297/337; 297/342

[58] Field of Search ..... 297/311, 317, 318, 322, 297/329, 337, 341, 342, 353, 354, 355, 285, 286, 289, 299, 300, 306, 396, 403, 404; 248/371, 372, 395, 424, 429, 430

[56] References Cited

U.S. PATENT DOCUMENTS

| | | | |
|---|---|---|---|
| 1,435,741 | 11/1922 | Sadler | 297/292 |
| 1,712,727 | 5/1929 | Birdsall | 297/337 |
| 2,446,185 | 8/1948 | Masucci et al. | 297/337 X |
| 2,627,898 | 2/1953 | Jackson | 297/342 |
| 2,801,678 | 8/1957 | Brandon | 297/396 |
| 3,536,358 | 10/1970 | Masucci | 297/342 |
| 3,567,280 | 3/1971 | Bradshaw | 297/318 |
| 3,610,686 | 10/1971 | Caruso | 297/239 |

*Primary Examiner*—James C. Mitchell
*Attorney, Agent, or Firm*—Brumbaugh, Graves, Donohue & Raymond

[57] ABSTRACT

Optimal body weight distribution and excellent sacro-lumbar support is provided by a chair which changes configuration automatically to support the body in any sitting posture. The chair seat is mounted on a pair of laterally spaced-apart, elongated, substantially parallel seat supports disposed lengthwise of the chair, and the seat has sleeves that are received telescopically on the seat supports for sliding movement such that the seat slides forward and backward, relative to the chair back. The back tilts independently of the seat to conform to the sitting posture of a person sitting in the chair.

36 Claims, 34 Drawing Figures

FIG. 3
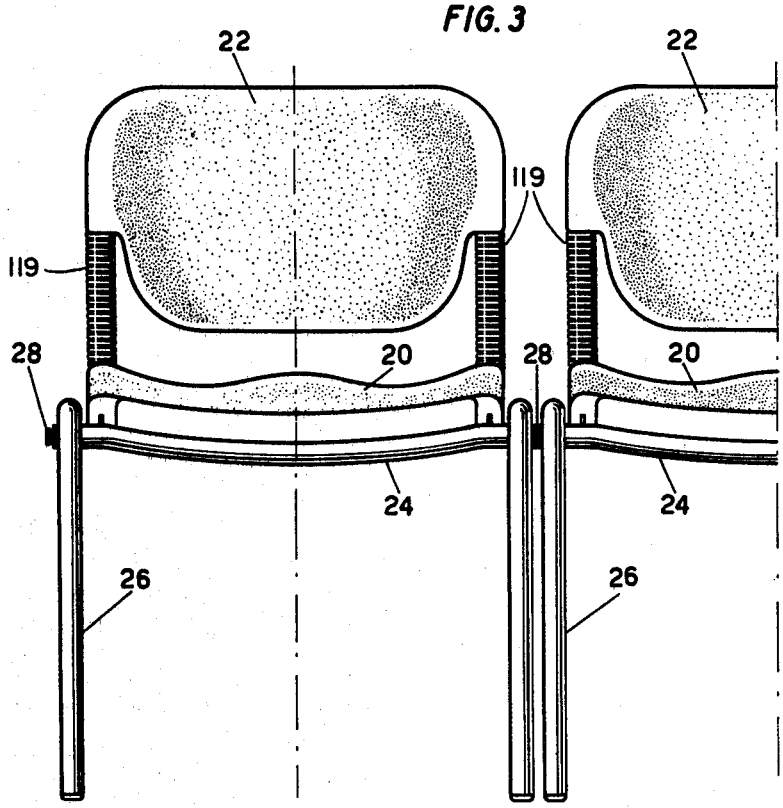
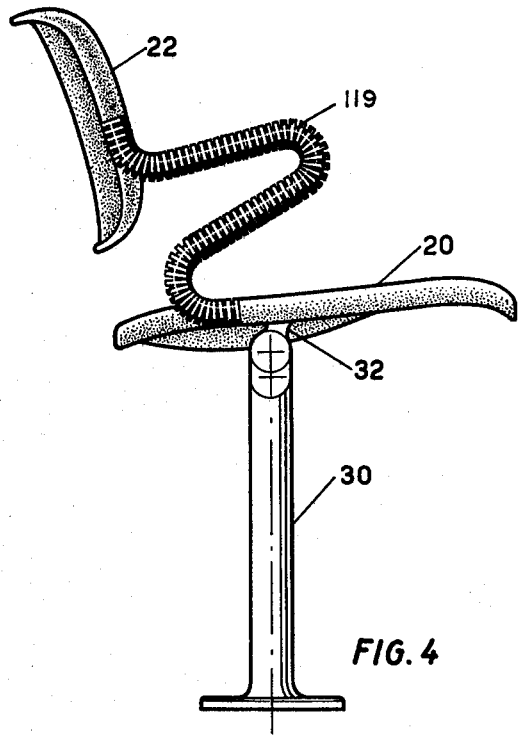
FIG. 4

FIG. 20
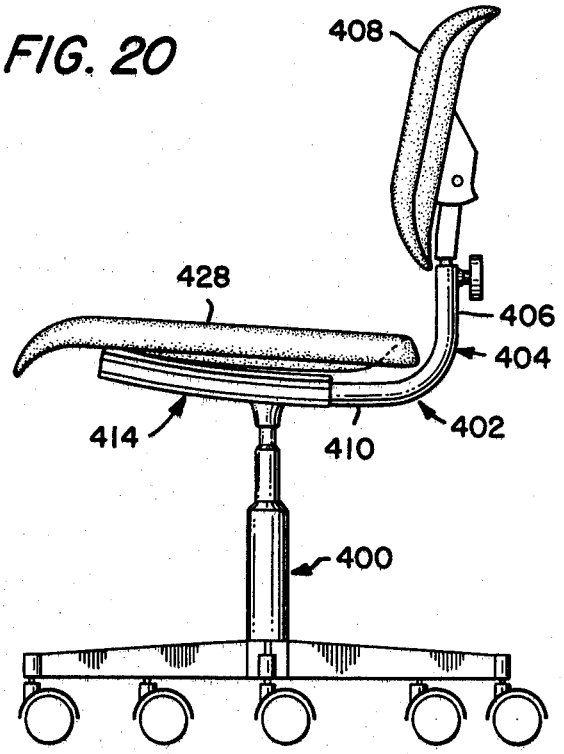
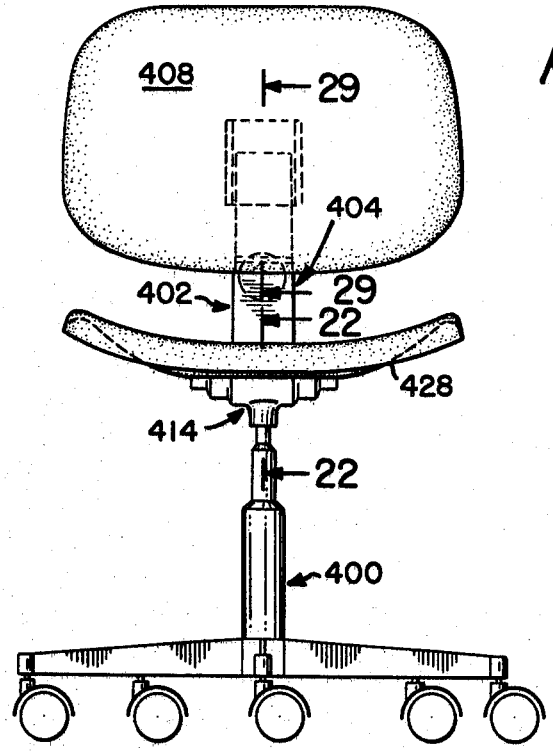
FIG. 21

CHAIR

BACKGROUND OF THE INVENTION

This application is a continuation-in-part of U.S. patent application Ser. No. 586,794 filed June 13, 1975, now abandoned.

In accordance with the invention of the inventor of the present invention described in U.S. patent application Ser. No. 492,693 filed July 29, 1974, now U.S. Pat. No. 3,982,785 a substantial improvement in the comfort of chairs is afforded by mounting the seat so that it moves back and forth and assumes an increased rake, the further forward it is moved, and by mounting the back so that it pivots independently of the movement of the seat between upright and inclined positions. The chair described in that application thus allows one to assume various sitting postures, and the orientation of the seat and the back of the chair will conform to any of a variety of sitting postures to make the chair much more comfortable than a conventional chair of fixed geometry. The chair described in that application is also based on a modular concept of construction that allows the specific configuration to be varied widely by using a minimum number of changeable components in various combinations.

SUMMARY OF THE INVENTION

There is provided, in accordance with the present invention, a chair having a movable seat and a pivotable back that is functionally equivalent to the chairs described in the prior application referred to above in that the comfort of the chair is significantly greater than a conventional chair in a wide variety of sitting postures assumed by the user, but provides the functional features by way of unique and less costly structures. Accordingly, while the structure of the chairs of the present invention does not offer the advantage of the modular concept embodied in the prior chairs, it offers the advantages of economy and ease of manufacture, as well as offering alternative structural systems to the ones described in the prior application.

A chair according to the present invention comprises a frame that includes at least one back support and a pair of laterally spaced-apart, elongated seat supports that extend parallel to each other and to the lengthwise axis of the chair. Each of the seat supports is of substantially uniform external cross section throughout its length. The chair seat has a pair of laterally spaced-apart elongated sleeves, each of which receives one of the seat supports, and is of substantially uniform internal cross section along its length, such cross section being substantially complementary to the external cross section of the seat support with a clearance such that the seat is slidable forward and backward on the seat supports.

In chairs in which the seat has little or no padding, it is highly desirable to make the seat supports and the sleeves upwardly concavely arcuate (i.e., curved about a center of curvature located some distance vertically above the coincident axes of the respective sleeves and seat supports) so that the rake of the seat increases, the farther forward it is on the supports. In chair seats that are relatively heavily padded, the seat supports and sleeves need not be curved, inasmuch as the padding will provide comfortable support to a person sitting in the chair in all positions of forward and backward movement, even though the shifting of the seat to a more forward position, as the person leans back to a relaxed position in the chair, requires the imposition by the seat to the person of a greater horizontal force component so that the person does not have the feeling that he will slide off the seat. Heavy padding provides the necessary change in geometry that is present when curved sleeves and supports are used in lightly padded or unpadded seats.

Preferably, at least one resilient coupling is interconnected between the seat supports and the seat to urge the seat toward its rearwardmost position on the supporting structure. Interengageable parts on the seat and seat supports provide limits on the extent of forward and backward movement.

The back of the chair is mounted on the back support (or supports) for pivotal movement by pivoting or articulating coupling. For example, the back may have a socket (or sockets) which receives one part of a coupling on the back support; a second part of the coupling is suitably connected to the back support. An appropriate resilient system is associated with the pivoting or articulating coupling so that the back normally assumes a given position in the absence of the application of an external force to the back and so that the back provides some resistance to tilting; the back should, to be comfortable, resist tilting, so that the back of the sitter will be supported in a variety of sitting postures. The present invention provides several forms of articulating, resilient couplings for mounting a pivotable back on a pair of spaced-apart back supports.

In some embodiments, back supports and seat supports are portions of a unitary frame member. For example, the chair may have two "L"-shaped frame members, the base leg of the "L" constituting the seat support and the vertical leg of the "L" constituting the back support. Alternatively, the chair frame member may be generally "Z"-shaped, the bottom leg of the "Z" being the seat support and the top leg of the "Z" being an armrest. In the "Z"-shaped form of member, the back is pivoted from the free ends of the upper legs.

In conjunction with both the "L" and "Z" forms of frame members, as well as with other configurations of unitary frame members having back and seat supporting portions, the present invention also includes a flexible, extensible tubular covering over the tubular frame members and connected at one end to the seat and at the other end to the back, such as by way of annular flanges associated with the sleeves on the seat and sockets on the back. The tubular covering flexes and extends and contracts in accordance with movements of the seat and back and permits mechanically effective structures to be used in connection with the movements of the seat and back, some of which might detract from the appearance of the chair without the coverings. The coverings also provide protection for the moving parts, particularly by keeping out dirt, and improve the comfort of the armrests of chairs that have them.

For a better understanding of the invention, reference may be made to the following description of exemplary embodiments, taken in conjunction with the figures of the accompanying drawings.

DESCRIPTION OF THE DRAWINGS

FIG. 3 is a front elevational view of one chair and part of another ganged side-by-side, the chairs being of the type shown in FIGS. 1 and 2;

FIG. 4 is a side elevational view of a chair similar to that shown in FIGS. 1 to 3 but having armrests and a pedestal base;

FIGS. 20 and 21 are side elevational and front elevational views of another form of chair;

DESCRIPTION OF THE EXEMPLARY EMBODIMENTS

Figure 1:
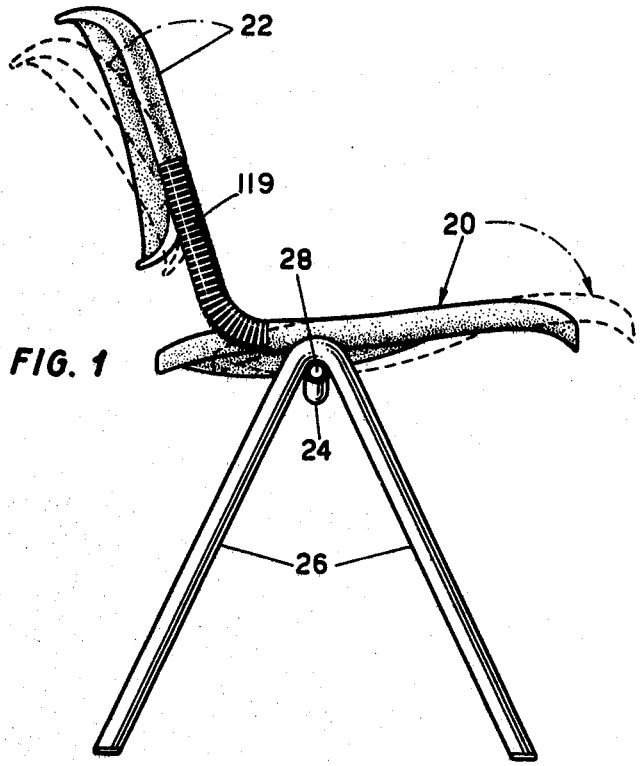
FIG. 1 is a side elevational view of one form of chair, according to the invention, illustrating by solid lines one seat and back position and by phantom lines another position of the seat and back.
Figure 2:
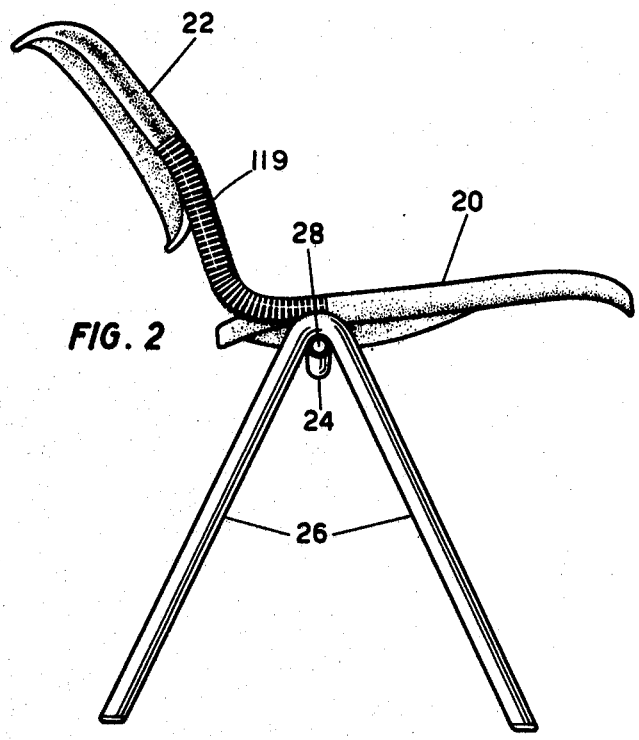
FIG. 2 is a side elevational view of the chair of FIG. 1 showing the seat in a forward and upwardly raked position and the back in a tilted position.

Referring to FIGS. 1 to 3 of the drawings, a chair, according to the present invention, comprises a seat 20 that is movable between a rearward, relatively horizontal position, as shown in solid lines in FIG. 1, and a forward, relatively inclined or raked position, as shown in phantom lines in FIG. 1 and in solid lines in FIG. 2, and a back support 22 that tilts, independently of the position of the seat, between a relatively upright position as shown in solid lines in FIG. 1 and in inclined position as shown in phantom lines in FIG. 1 and in solid lines in FIG. 2. The details of the structures by which the seat and back are made movable are, of course, described in greater detail below. The chair of FIGS. 1 to 3 includes laterally spaced-apart side members (not visible in FIGS. 1 to 3) that are generally "L"-shaped in side elevation, the bases of the "L"'s providing supports for the seat and the vertical parts of the "L"'s providing supports for the back. The side members are rigidly joined to a transverse beam-like member 24 that extends under the seat, and inverted "V"-shaped legs 26 are joined to the ends of the transverse member 24. The side members, transverse member and legs are preferably made of steel of aluminum tubing and are welded into a rigid, composite frame.

As shown in FIG. 3, a suitable type of key-type connector 28 can be provided at each end of the transverse member 24 to join two or more chairs in ganged, side-by-side relation, an attribute often required, or at least desired, for seating used in auditoriums, lecture halls, theaters and similar places. The precise structure of connectors 28 can vary widely, and numerous types are well known. Advantageously, the connectors 28 are designed so that the chairs can readily be taken apart. As is apparent from FIGS. 1 and 2, the configuration of the chairs shown in FIGS. 1 to 3 is such that they are stockable.

The chair shown in FIG. 4 of the drawings is very similar to that shown in FIGS. 1 to 3, except that instead of having "L"-shaped side members, it has "Z"-shaped side members, and instead of having legs, it is mounted on a pedestal 30. The configuration of the seat 20, back 22 and the manner in which they are mounted may be identical to those used in the embodiment of FIGS. 1 to 3, as hereinafter described and as shown in other figures of the drawings. The bottom leg of the "Z" is a seat support, and the top leg of the "Z" is an arm. The back is attached at the free ends of the arms in any of the ways described below. For a pedestal mounting, the transverse member 24 of the chair has a socket to receive a post 32. The "Z" side frames and pedestal legs are alternative features that may, of course, be used individually in modifying the basic chair shown in FIG. 1. The basic chairs of the configurations of either FIGS. 1 to 3 or FIG. 4 can be mounted individually or in groups on pedestals or on other supports, such as long horizontal beams that carry several chairs, an arrangement common in, for example, theater, auditorium and stadium seating.

The seats 20 of the chairs shown in FIGS. 1 to 4 have a sleeve 34 located on the under side and at each side.

Each sleeve 34 receives telescopically a seat support 36 that is part of the chair frame. (In the chairs of FIGS. 1 to 4, the seat supports 36 are parts of the "L"-shaped or "Z"-shaped side members of the frame.)

The seat supports 36 extend parallel to each other and to the lengthwise axis of the chair, and each is of uniform external cross-section throughout its length. The sleeves 34 are also parallel, and each is of uniform internal cross-section. The internal cross-section of each sleeve matches with a small clearance the external cross-section of the seat support such that the sleeves are slidable on the seat supports so that the seat moves forward and backward.

Figure 5A:
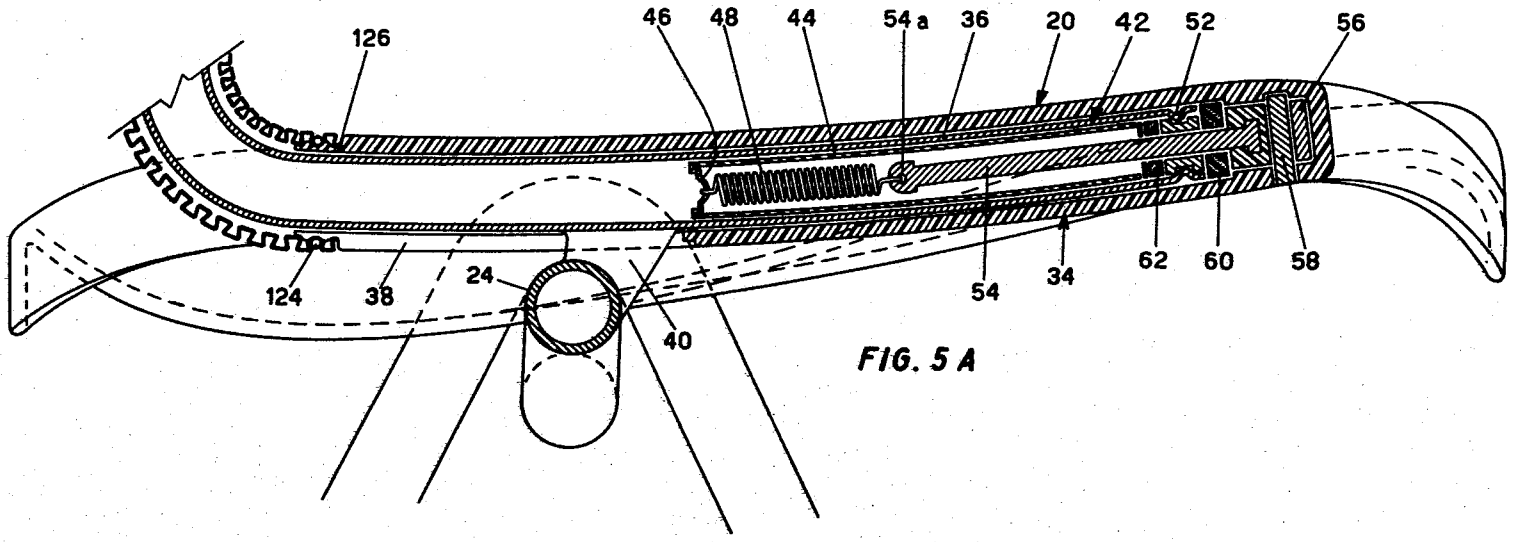
FIGS. 5A and 5B are views in side cross-section showing the details of the mounting of the seat on the seat supports as it appears in the rearwardmost and forwardmost positions, respectively.
Figure 5B:
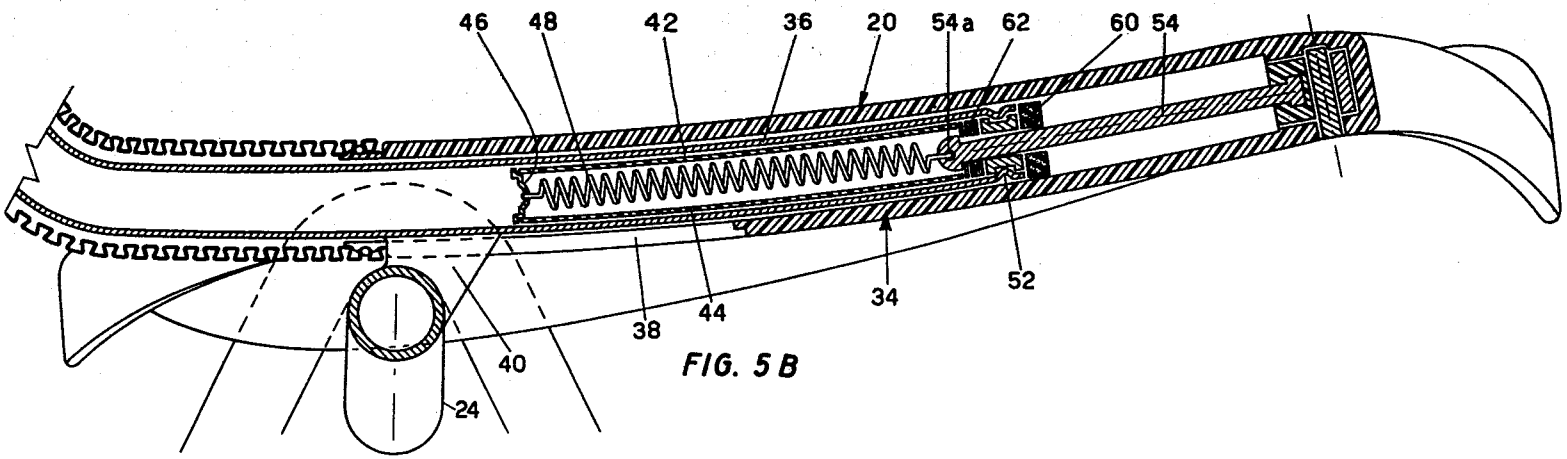

In chair seats having little or no padding, such as the seat 20 shown in FIGS. 5A and 5B, the seat supports 36 and sleeves 34 have axes forming an upwardly concave circular arc that defines a vertical plane; in other words, the axis of each sleeve and seat support is a curve of uniform radius having its center vertically above the axis. Thus, as the seat slides forward and backward on the seat supports, its rake changes, the rake being increased the farther forward the seat slides. In chairs having heavily padded seats, the sleeves and seat supports need not be curved, because the padding compensates for the lack of curvature by accommodating the sitting posture of the person sitting in the chair.

As is apparent from a comparison of the two positions of the seat on the seat support shown in FIGS. 5A and 5B, the degree or range of change in rake of the seat as it moves forward and back is a function of the curvature of the coincident axes of the seat support 36 and the sleeve 34 and may, of course, be selected with a view to providing the desired change as a matter of comfort to the user.

Because the sleeves 34 of the seat 20 in the chairs of FIGS. 1 to 4 are located under the top of the seat at the side edges, they constitute a dependent structure that imparts substantial strength and rigidity to the seat. In addition, the underside of the seat may be suitably reinforced by ribs or webs. Both the seat and back are preferably formed of a high-impact strength plastic, although other materials may, of course, be used, and the seat and back may be upholstered and lightly or heavily padded (as mentioned above).

As is best seen in FIG. 5A, a longitudinal slot 38 is provided in the back part of the bottom of each sleeve 34 to permit the reception within the back of the sleeve of a mounting bracket 40 that joins each of the side frame members to the transverse member 24.

The rearwardmost and forwardmost positions of the seat are established by suitable stops which, preferably, as in the illustrated embodiments, are associated with a spring return mechanism that urges the seat to its rearwardmost position on the support. As shown in FIGS. 5A and 5B, one form of spring return and stop mechanism (designated generally by the reference numeral 42) comprises a tubular spring holder 44 having an end wall 46 to which a coil spring 48 is attached. The spring holder 44 is inserted through the front end of the seat support 36 and is retained in the seat support 36 by a crimped connection 52. A link 54 is connected between the spring 48, which is under tension, and a connector 56 that is received in the forward end of the sleeve 34 and fastened in place by a retainer pin 58. The spring return mechanism 42, including the connector 56, is an assembly which, during construction of the chair, is installed in each seat support 36 prior to mounting the seat 20. To install the seat, all that is required is to slide it onto the seat support into the rearwardmost position and insert the retaining pin 58 through a hole in the bottom of the forward end of the sleeve 34; the pin may be glued in place, or it may be threaded to be retained in a threaded hole in the connector 56.

The rearward stop position of the seat on the seat support is established by engagement of the forward end of the seat support 36 with the forward end of the sleeve 34, preferably with an elastomeric bumper 60 interposed to cushion impact, should the seat be permitted to return rapidly from a forward position to the rearwardmost position. The forward stop position is established by engagement of an enlarged head **54*a* on the link with an elastomeric bumper or cushion 62 positioned adjacent the retainer 50 of the spring return of mechanism 42 (FIG. 5B**).

Figure 7:
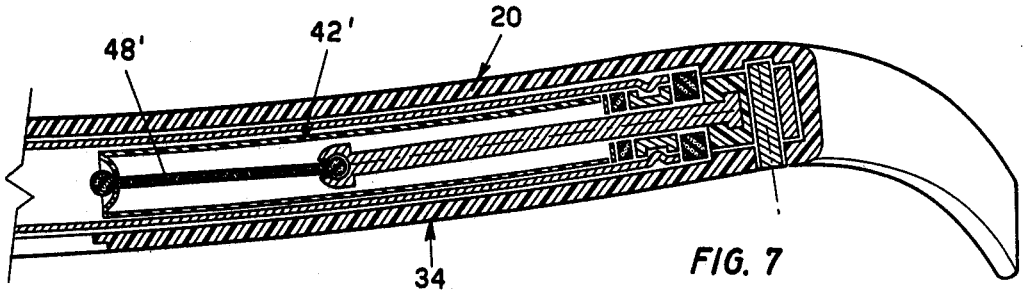
FIG. 7 is a side view in cross-section of an alternative form of resilient coupling and limit stop arrangement between the seat and a seat support.

FIG. 7 of the drawings shows, as a modification of the spring return mechanism of FIGS. 5A and 5B, the substitution for the coil spring 48 of a resilient extensible strand or band 48'. Otherwise, the mechanism 42' of FIG. 7 is the same as that of FIGS. 5A and 5B. In general, mechanical spring return devices will be the least expensive and most effective types of spring return devices for use in the chair, but it will be apparent to those skilled in the art that other types, such as pneumatic types, may readily be substituted for the spring return devices shown in FIGS. 5A, 5B and 7 of the drawings.

Figures 6A, 6B:
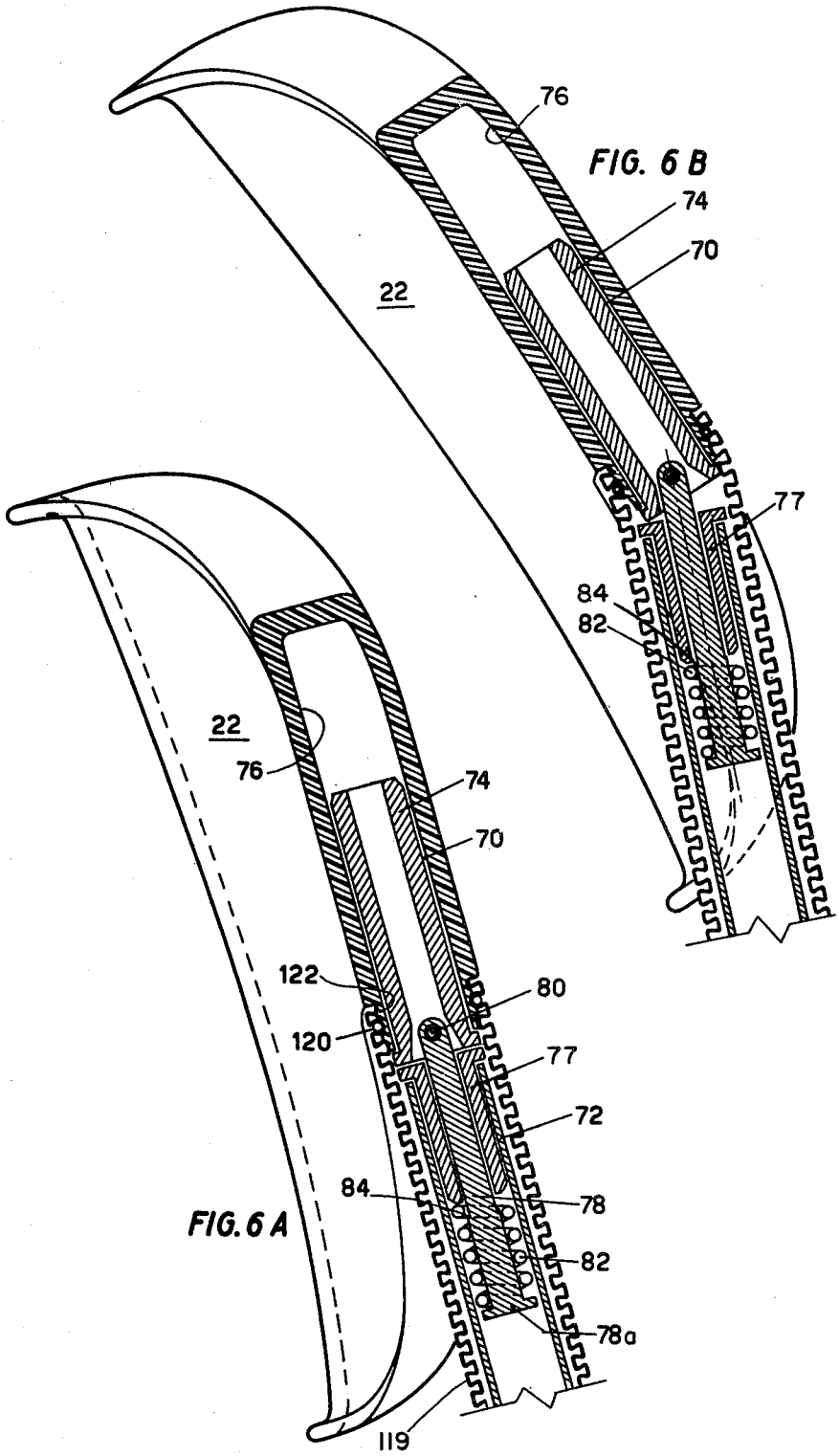
FIGS. 6A and 6B are side cross-sectional views showing one form of articulating connector by which the back is mounted on the back supports and showing the back in an upright and in a rearwardly tilted position, respectively.

FIGS. 6A and 6B illustrate the details of one form of a resilient articulating connector 70 for mounting the back of the chair 22 on the back supports 72. Each back support 72 is constituted by the upper end portion of the tubing that is bent to form the generally "L"-shaped or "Z"-shaped side frame member of the chair or an equivalent member. The back 22 is connected by the connector 70 to the upper end of each of the two back supports 72 by reception of an upper part 74 of the connector in a socket 76 provided at each end of the back.

The resilient, articulating connector shown in FIGS. 6A and 6B comprises a lower tubular part 77 that is received and glued, welded, crimped or otherwise secured in place in the upper end of the back support 72. A link 78 extends through the lower part 77, is connected at its upper end by a pivot pin 80 to the upper part 74, and receives a coil spring 82 held under compression between a flange **78*a* at the lower end of the link 78 and the bottom end of the lower part 77. Thus, the spring 78 draws the abutting, annular faces of the upper and lower parts of the connector into engagement and, as shown in FIG. 6A**, tends to hold the connector straight and urge the back into a generally upright position.

The forces imposed on the chair back, such as the forces exerted by the back of one sitting in the chair against the chair back, will control the tilt of the back. For example, FIG. 6B illustrates a rearward tilting of the chair back to a position it would tend to assume when a person sitting in a chair is sitting in a somewhat reclined position. The connector 70 allows the back to move to different orientations as a result of forces imposed on the chair back by increased compression of the spring 82 and a rocking of the upper parts 74 of the connector along the back edge of the upper end of the lower part 77. The back may assume any of an infinite number of positions, relative to the back support 72, as determined by the position of the back of the person sitting in the chair; thus, the back may also tilt forward rather than backward. The limit positions of tilting of the back may be established by designing the spring 82 to become fully compressed at some point, thereby restricting further tilting of the back. Alternatively, as in the embodiment shown in FIGS. 6A and 6B, a shoulder 74 can be provided on the link 78 in a position to engage the lower end of the lower part 77 of the connector at some predetermined position (see FIG. 6B), thereby preventing the link from moving up any farther and limiting further tilting of the back.

The seat back may be made of various materials, such as cast, molded or stamped metal or high-impact strength plastic. Both the seat and the back may be provided with cushions, upholstered or otherwise given a desired surface treatment.

Figure 8:
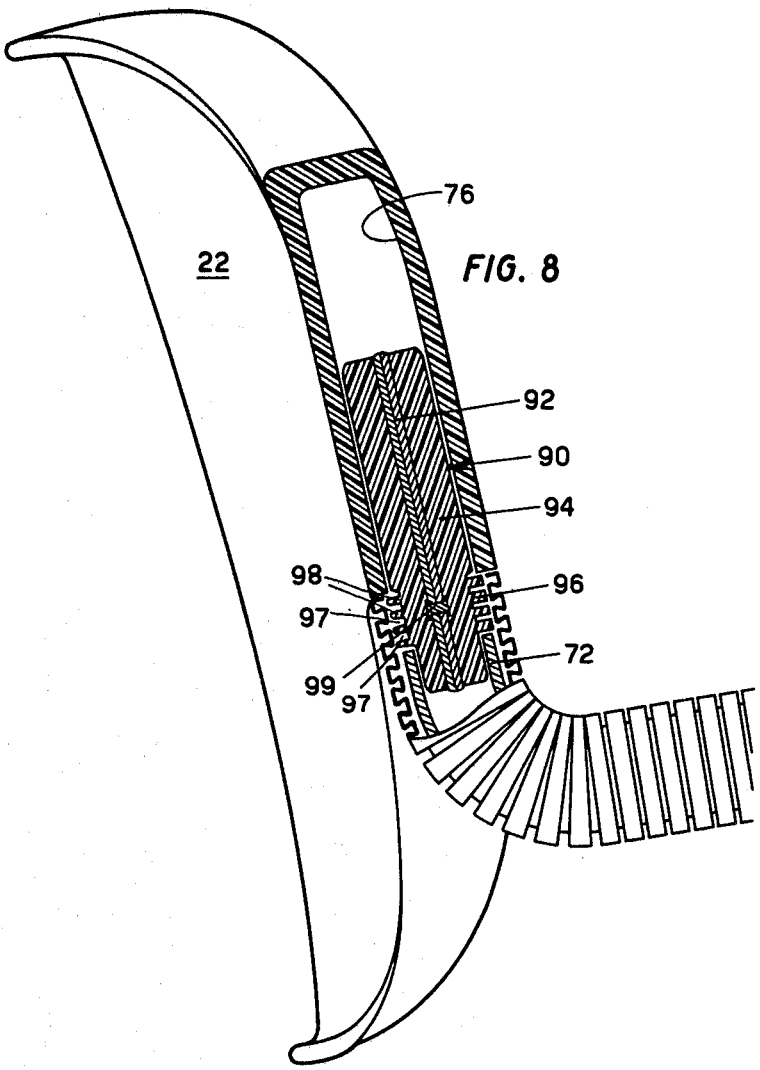
FIG. 8 is a side view in cross-section showing an alternative form of resilient, articulating connector for mounting the back on the back support.

Various alternative constructions may be used for the resilient articulating connector between the back and the back support. For example, as shown in FIG. 8, another form of connector 90 comprises one or more leaf springs 92 molded into a flexible plastic or rubber casing 94, the upper end of which is received and secured in the socket 76 in the seat back and the lower end of which is received and secured in the upper end of the seat support. The extent of tilting in both forward and rearward direction is controlled by providing an enlarged portion 96 on the casing 94 and forming grooves 97 of predetermined widths in the enlarged portion of such dimensions and shapes that when the casing is bent, the ribs 98 defined by the grooves 97 engage each other and become clamped between the upper end of the seat support 72 and the lower edge of the socket 76, thereby preventing additional flexure of the casing 94. Although one leaf spring is workable, a stack of springs joined together, such as by a rivet 99, is preferred.

Figure 9A:
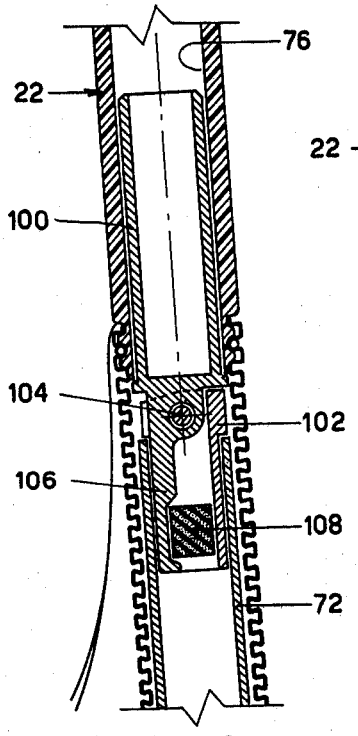
FIGS. 9A and 9B are side views in cross-section of another resilient, articulating connector for mounting the back on a back support and showing, respectively, an upright and a tilted position of the back.
Figure 9B:
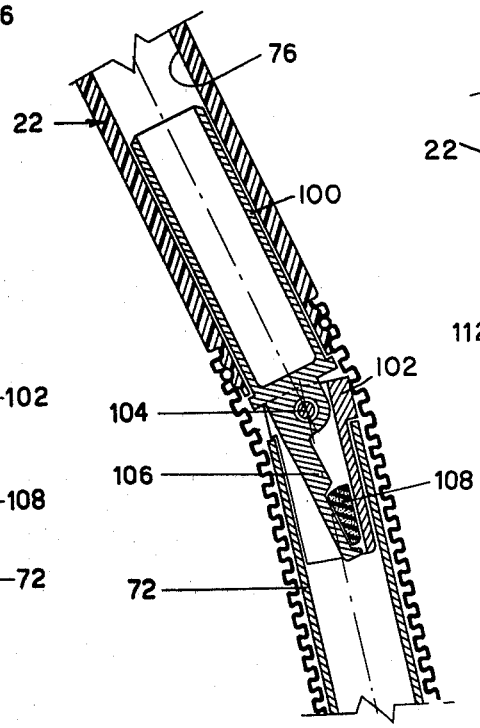

The resilient articulating coupling shown in FIGS. 9A and 9B comprises an upper part 100 received in the socket 76 of the chair back and a lower part 102 received in the end of the back support 72. The upper and lower parts 100 and 102 are connected to each other for articulation by a pivot pin 104, and a lever arm 106 on the upper part extends down into the lower part. A body 108 of a resiliently compressible material is received between the lever arm 106 and the wall of the lower part 102. As shown in FIG. 9B, the connector allows the back to tilt rearwardly under an external force imposed on it, thereby compressing the body 108. In the absence of an external force on the back 102, the compressible body resiles and restores the back to the upright position, as shown in FIG. 9A.

Figure 10:
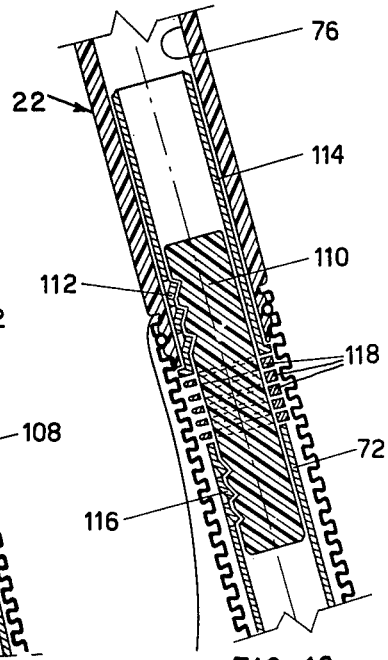
FIG. 10 is a side cross-sectional view of another resilient, articulating connector for mounting the back on a back support.

Another form of connector for mounting the chair back on the back supports, as shown in FIG. 10, consists of a rod 110 of an inherently resilient material, such as rubber, the upper end of which is secured, such as by crimping 112, in a casing 114 that is fastened, such as by gluing, in the socket 76 of the seat back, and the lower end of which is secured, such as by crimping 116, in the upper end of the back support 72. The extent of bending permitted by the connector 110 is limited by a stack of tapered non-compressible rings 118 interposed between the upper end of the back support 72 and the lower end of the tubing 114. A force imposed on the back results in flexure of the connector, and the inherent resiliency of the material will restore the seat back to its upright position upon release of the force.

Referring again to FIGS. 1 to 4 of the drawings, the otherwise exposed portions of each of the side frame members between the seat and the back and parts of the connectors are concealed, protected, and given a pleasing appearance by a covering in the form of an extensible and flexible tubing 119, one end of which is attached, such as by a split resilient clamp ring 120 (see FIGS. 6A and 6B), to an annular flange 122 at the lower end of the socket 76 of the chair back 22 and the other end of which is attached, such as by another split resilient clamp ring 124 (see FIGS. 5A and 5B), to an annular flange 126 at the rearward end of the sleeve 34 on the seat. The tubing 119 may be any form of resilient extensible flexible tubing material cut to an appropriate length. For example, a corrugated or plain rubber tubing, corrugated or plain extensible spring-wire reinforced spiral tubing, or tubing constituted by a multiplicity of closely spaced rings interconnected by webs and formed of a flexible, preferably resilient material, may be used as the covering for the frame members.

Although it is generally preferable to provide a separate spring return for the seat, such as one of the spring return mechanisms shown in FIGS. 5A, 5B and 7, to restore the seat to its rearward position in the absence of a force tending to move it away from the rearward position, an elastic covering connected to the seat at one end and either to the back or to some point remote from the seat at the other end can provide the function of restoring the seat to the rearward position, a separate spring return mechanism being omitted in such instances.

Figure 11:
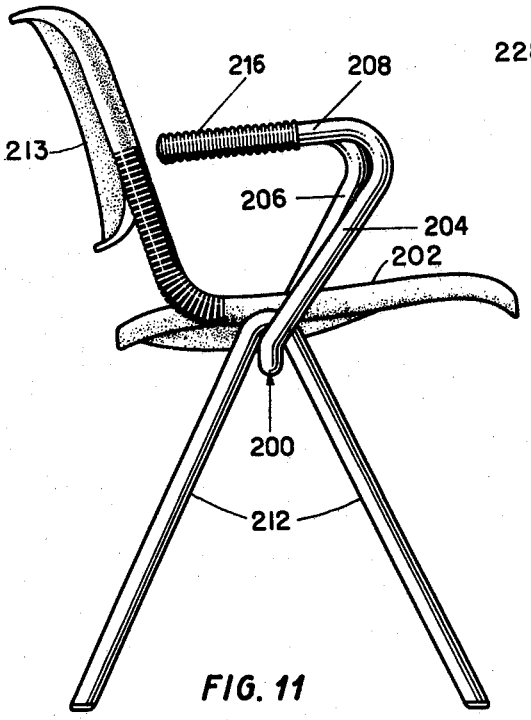
FIG. 11 is a side elevational view of another embodiment of a chair, according to the invention.
Figure 12:
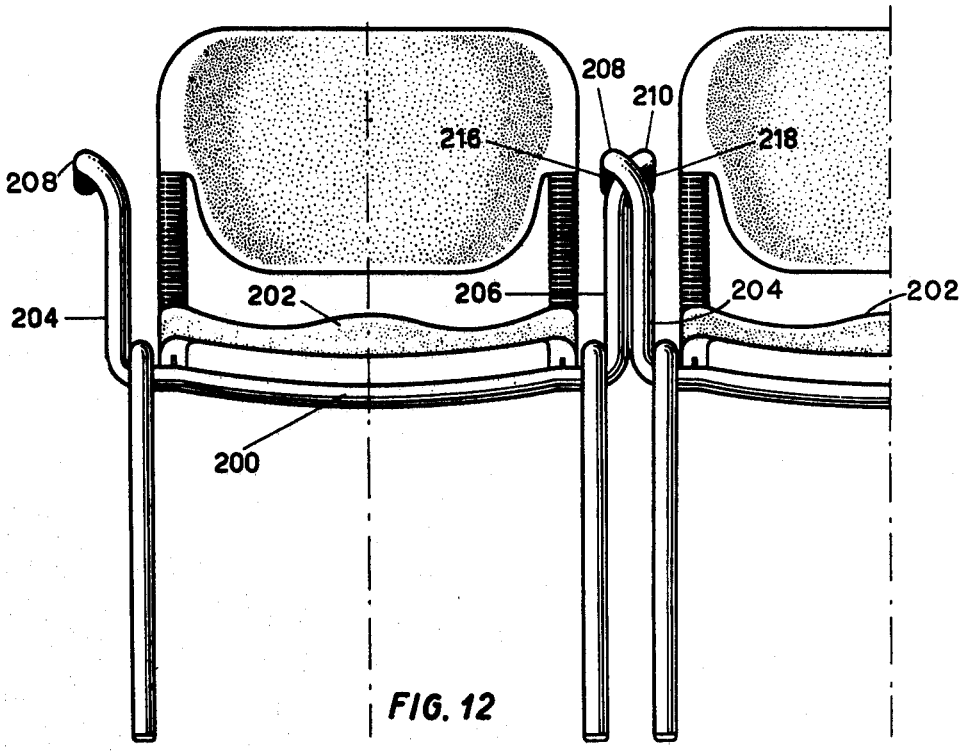
FIGS. 12 and 13 are front and top views, respectively, of two chairs of FIG. 11, ganged side-by-side, only part of one of the chairs being shown.
Figure 13:
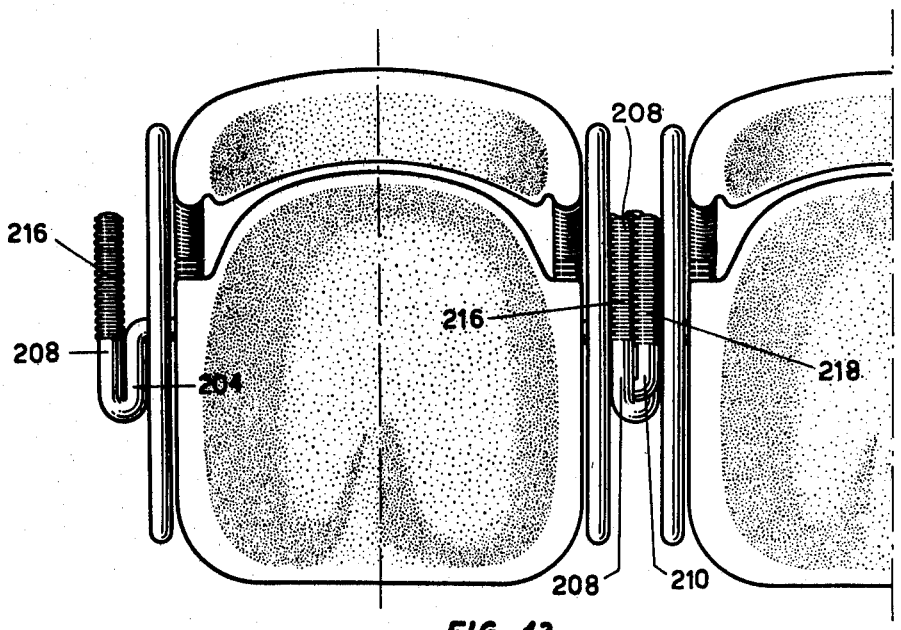
Figure 15A:
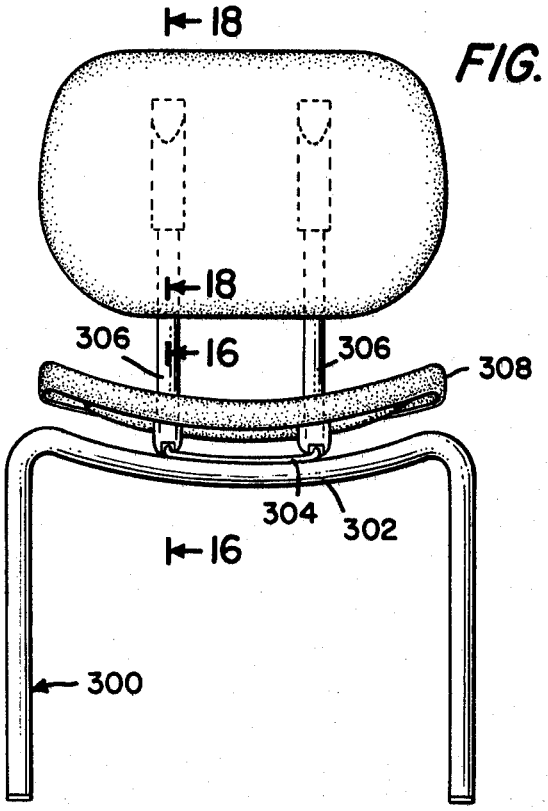
FIGS. 15A and 15B are front elevational and side elevational views, respectively, of another form of chair embodying the invention.
Figure 15B:
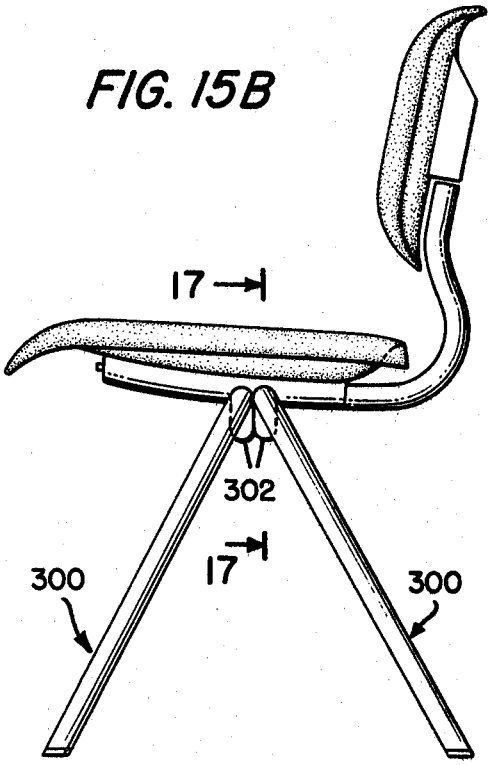
Figure 16:
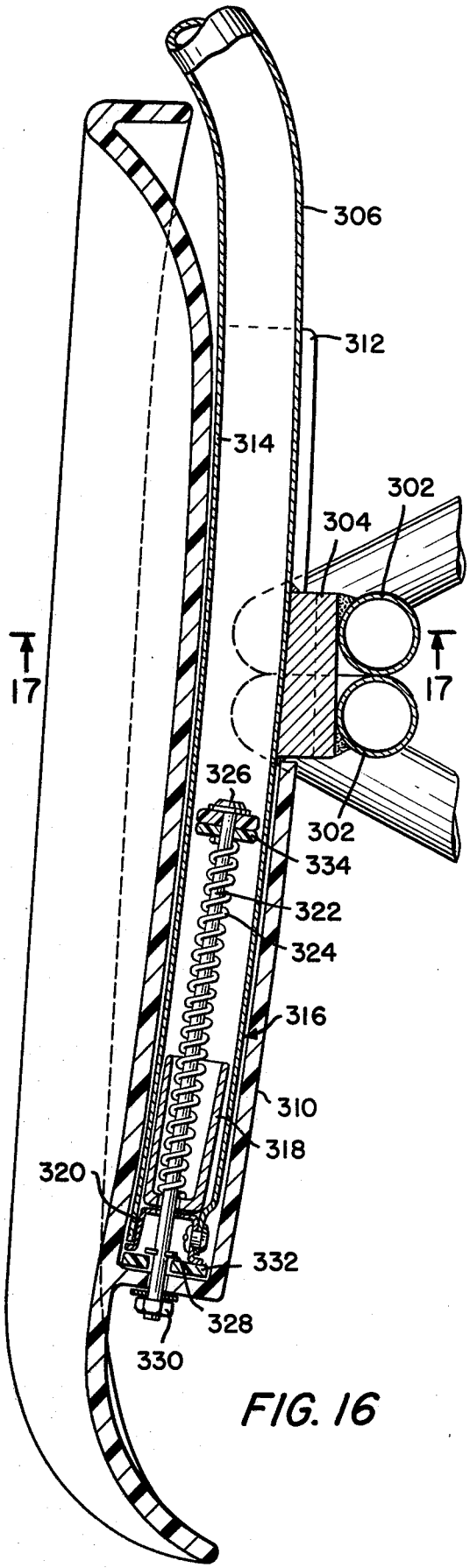
FIG. 16 is a side cross-sectional view of a seat support of the seat of the chair of FIGS. 15A and 15B, the view being taken generally along the plane represented by the lines 16—16 of FIG. 15A and in the direction of the arrows.
Figure 17:
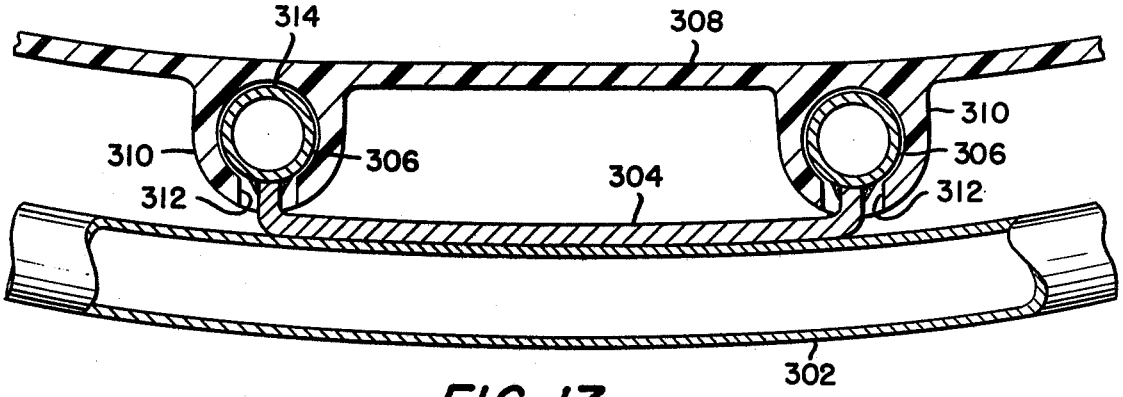
FIG. 17 is a fragmentary, cross-sectional view taken generally along the lines 17—17 of FIGS. 15B and 16 and in the direction of the arrows.

FIGS. 11 to 13 of the drawings illustrate a chair having legs, a seat and a back constructed in a manner substantially the same as the chair shown in FIGS. 1 to 3 and embodying one or the other of the various alternative components described herein and shown in the other figures of the drawings but, in addition, having a special form of arm structure that permits the chairs easily and quickly to be ganged side-by-side and to be held together firmly and securely by means of interlocking between the arms. The interlocking arms feature of the chair shown in FIGS. 11 to 13 is, per se, not part of the present invention, being claimed in divisional application Ser. No. 759,077 filed Jan. 13, 1977 and based on this application. In the embodiment shown in FIGS. 11 to 13, the arms are integral extensions of a transverse frame member 200 that extends under the seat 202, turns upwardly and forwardly at each end to provide armrest supports 204 and 206 at opposite sides of the chair and then is bent rearwardly and outwardly at each end to form a juncture with a pair of armrests 208 and 210. The legs 212, seat 202 and back 213 are substantially identical to the corresponding parts of the chair shown in FIGS. 1 to 3 and described hereinabove.

It will be observed by considering FIGS. 11, 12 and 13 together that the armrest support 204 is bent forward slightly more than the support 206 such that the curved portion at its upper end at the juncture between it and the armrest 208 is located somewhat forward of the juncture between the armrest support 206 and the armrest 210. As FIG. 13 best illustrates, the objective is to have the juncture between the armrest 210 and its support 206 located relative to the juncture between the armrest 208 and its support 204 such that the two junctures of the armrests of adjacent ganged chairs interengage front to back. In addition, both armrests 208 and 210 are displaced outwardly from their respective supports by a distance substantially equal to the thickness of the armrest, so that, as can be seen in FIGS. 12 and 13, the armrests of the two adjacent ganged chairs interengage inside to inside. In other words, the geometric configurations of the two armrests of a single chair are such that several chairs can be ganged together side by side with their armrests in engagement inside to inside and with the junctures between the armrests and the armrest supports engaging front to back.

The interengagement of the armrests, as described above and shown in the drawings, keeps adjacent chairs from moving laterally away from each other, but does not completely prevent the possibility of one moving backward relative to the other or from a degree of pivoting about a vertical axis generally in the area of the interengagement zones between the junctures. Thus, it is preferable to provide interlocking between the chairs to prevent them from moving back and forth relative to each other and from pivoting slightly relative to each other. The first of those functions is fulfilled by the provision of arm covers 216 and 218, each of which is composed of a series of spaced-apart rings 220 or 222 interconnected in closely-spaced relation by narrow webs 224 or 226, the cover preferably being molded from a suitable substantially rigid plastic. The armrest covers are shown in detail in FIG. 14 in conjunction with the armrests of two adjacent chairs interlocked in the way shown in FIGS. 12 and 13.

Figure 14:
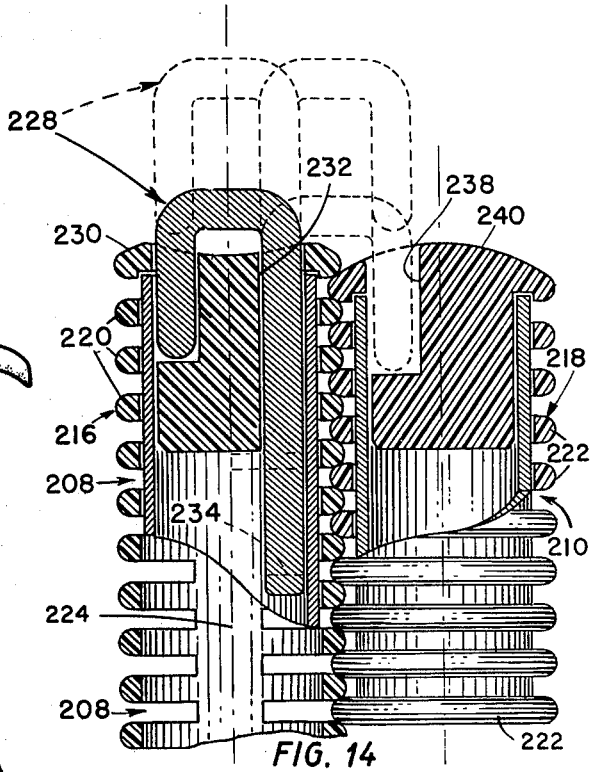
FIG. 14 is a detail view in cross-section of a connector for joining the free ends of adjacent arms of ganged chairs of the type shown in FIGS. 11 to 13.

More particularly, as shown in FIG. 14, a cover 216 associated with one armrest 208 is mounted on the armrest 208 such that its rings 220 will nest between the rings 222 of the cover 218 on the other armrest 210, thereby providing an interfitting relationship that prevents a chair in ganged relation with another from sliding backward and forward.

The possibility of one chair pivoting relative to the other around the area of interengagement of the junctures between the armrests and the armrest supports is prevented by a hook 228 (FIG. 14) is installed in a cap portion 230 of the armrest cover 216. The hook in the exemplary embodiment shown in the drawings is generally "J"-shaped, the longer leg extending through a hole 232 in the cap portion 230 and having a retainer flange or lug 234 that keeps it from being pulled entirely out of the cap portion by engagement with the inside face of the cap portion. For use of the chair separate from other chairs, the "J"-shaped hook 228 is kept in a position shown in solid lines in FIG. 14 in which a shorter leg is received in another hole 236 in the cap portion 230. As indicated by the dotted lines in FIG. 14, the hook is pulled out from the cap 230 and rotated through 180° and then pushed in so that the shorter leg is received in a hole 238 provided in an end cap portion 240 of the cover 218 of the other arm 210 of a pair of interengaging or interlocking armrests of adjacent ganged chairs.

FIGS. 15 to 19 show a number of variations and modifications in the construction of a chair, according to the present invention, and the mechanisms by which the back tilts and the seat moves forward and backward. The chair shown in those figures includes two leg members 300, each of which is of inverted "U"-shape. The two members are joined to each other at an angle in the respective cross portions 302, such joinder being conveniently provided by a generally "U"-shaped bracket 304 (FIGS. 16 and 17) that is welded to each of the cross portions and to a pair of laterally spaced-apart combination seat support-back support members 306. Thus, the bracket 304 joins the leg members 300 and the members 306 into a rigid frame. As shown in FIGS. 15A and 15B, the members 306 are generally "L"-shaped and are located some distance in from the sides of the chair seat 308.

The seat 308 has on its under side a pair of laterally spaced-apart parallel sleeves 310, each of which has a slot 312 to accommodate the ends of the bracket 304. Each sleeve 310 receives a seat supporting portion 314 of a respective frame member 306 in telescoping relation, as described above in connection with the other forms of chair shown in the drawings, such that the seat is slidable forward and backward on the frame.

The chair of FIGS. 15 to 19 includes a spring return and stop mechanism 316 located in the front end of each seat support 314. Each mechanism 316 includes a cup-shaped housing 318, a retainer 320, and a spring-loaded connecting rod 322. A spring 324 compressed between the housing 318 and a head 326 on the connecting rod 322 pulls the seat to its rearwardmost position, the seat being connected to the front end of the connecting rod by a snap ring 328 on the inside and a nut and washer 330 on the outside. A resilient bumper 332 cushions the impact of the end of the seat sleeve against the seat support 314 and establishes the rear limit position of the seat. Another bumper 334 establishes the forward limit position by engaging the back end of the housing 318.

Figure 18:
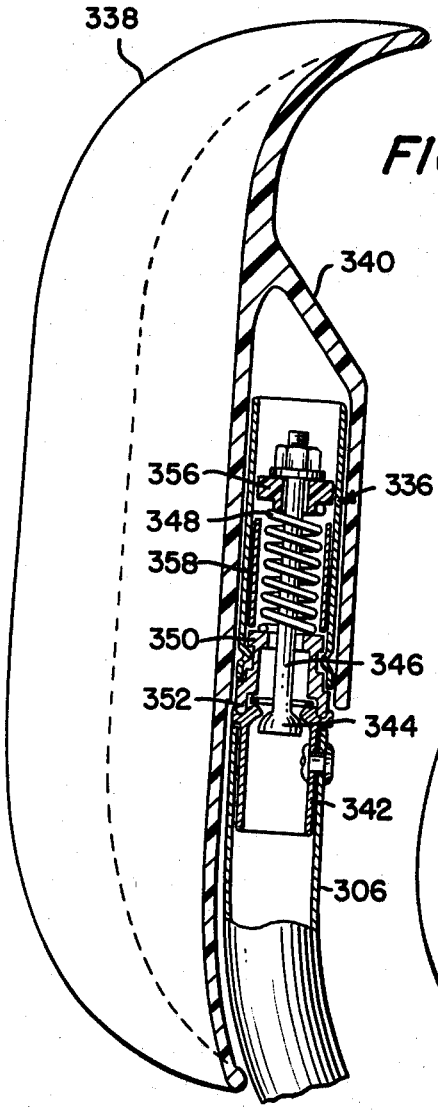
FIGS. 18 and 19 are cross-sectional views taken through the back of the chair of FIG. 15A generally along the lines 18—18 and in the direction of the arrows, FIG. 18 showing the back in upright position and in FIG. 19 showing it in an inclined position.
Figure 19:
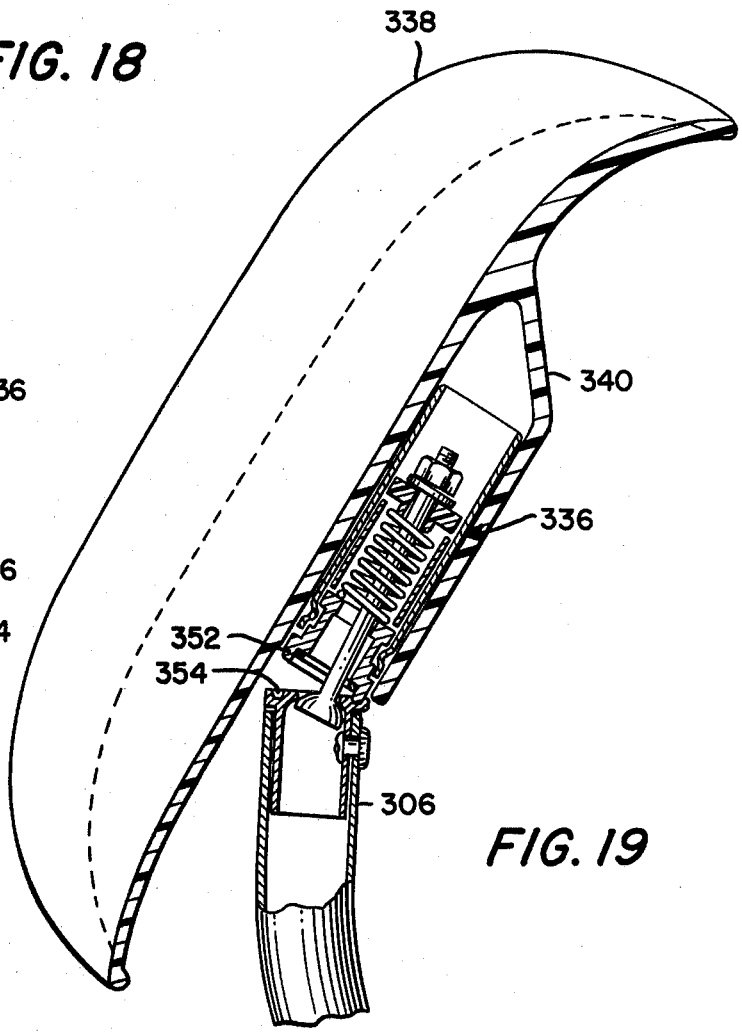

As shown in FIGS. 18 and 19, the upper ends of the members 306 are the back supports of the chair and receive resilient articulating couplings 336 which mount the chair back 338 for tilting movement between a relatively upright position (FIG. 18) and an inclined position (FIG. 19). The back 338 has a pair of laterally spaced-apart sleeves 340, each of which receives the upper part of a coupling 336. The couplings 336 are similar in structure and mode of operation to the coupling shown in FIGS. 6A and 6B.

The lower part 342 of each coupling is a cup-shaped retainer that is rivoted or otherwise fastened into the upper end of the back support 306 and which has a seat that is engaged by a hemispherical head 344 on one end of a connecting rod 346. A spring 348 compressed between the upper end of the connecting rod and a retainer 350 normally pulls the two parts of the coupling into alignment, the retainer 350 having an annular rib 352 that mates with a corresponding annular groove 354 at the upper end of the lower retainer 342 to maintain an articulating relationship between the two parts of the coupling in all positions of tilting. Engagement between a spring retainer 356 on the rod 346 and the upper end of a stop sleeve 358 establishes a limit on the extent of backward tilting of the back.

The chair shown in FIGS. 20 to 30 has a five-legged pedestal base 400 that supports at the height of a chair seat a generally "L"-shaped (as viewed from the side) frame assembly 402. The frame assembly includes a tubular piece 404 of generally rectangular cross-section bent to provide a generally vertical leg 406 that supports the back 408 of the chair and a generally horizontal leg 410 that receives telescopically a tongue 412 (FIGS. 22 and 23) that extends rearwardly from a seat support unit 414.

Figure 22:
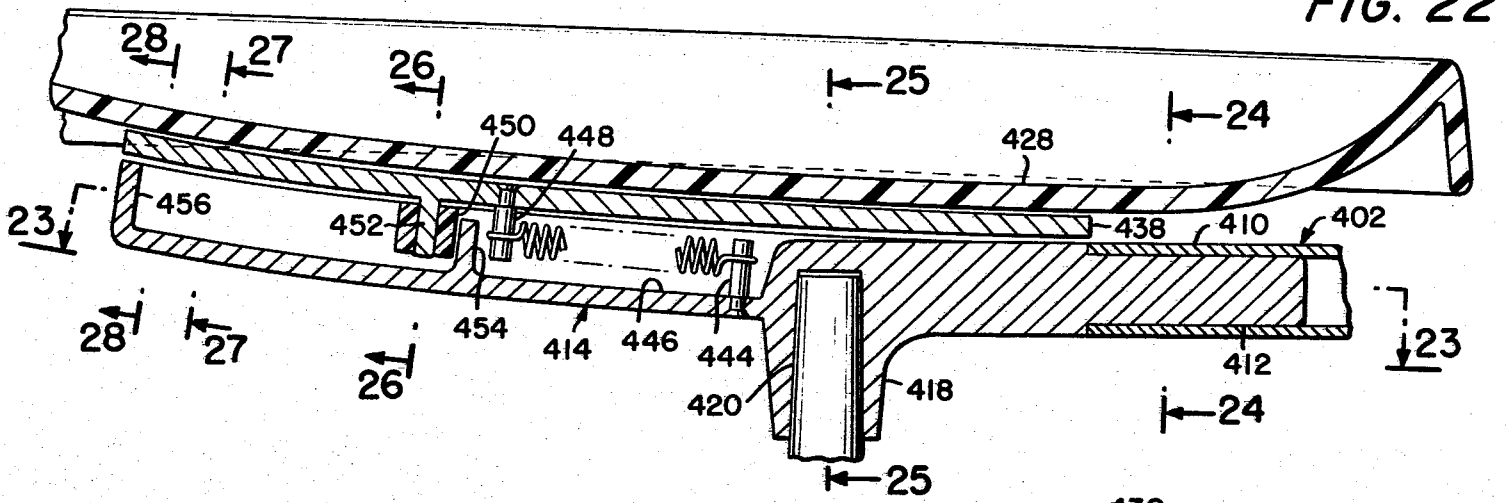
FIG. 22 is a side cross-sectional view of the seat supporting structure of the chair of FIGS. 20 and 21.
Figure 23:
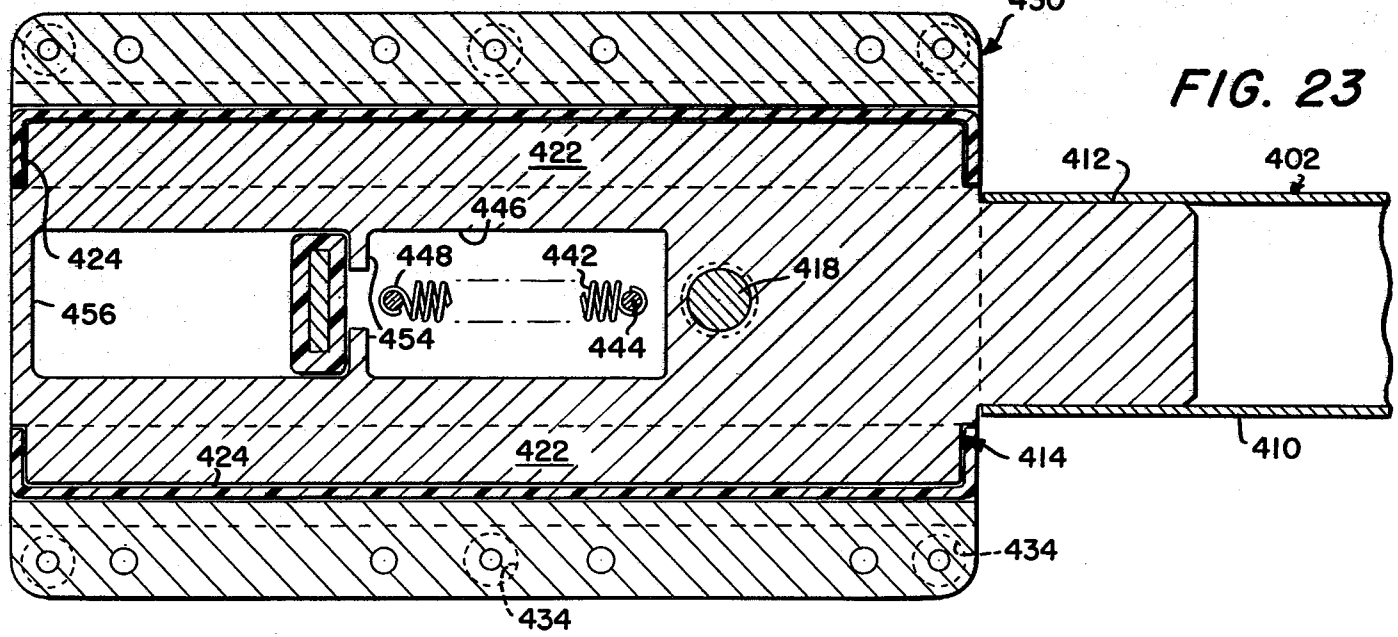
FIG. 23 is a top cross-sectional view of the seat supporting structure taken generally along the lines 23—23 of FIG. 22 and in the direction of the arrows.
Figure 24:
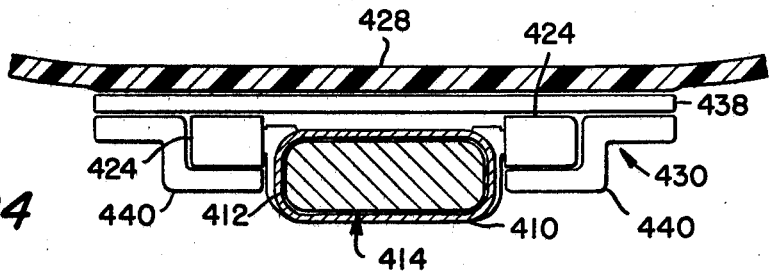
FIGS. 24 to 28 are cross-sectional views taken at the locations indicated by the correspondingly numbered lines in FIG. 22 and in the direction of the arrows.
Figure 25:
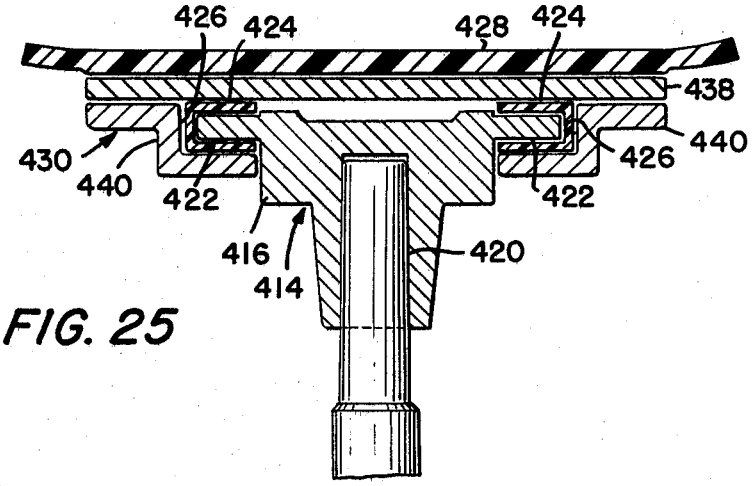
Figure 26:
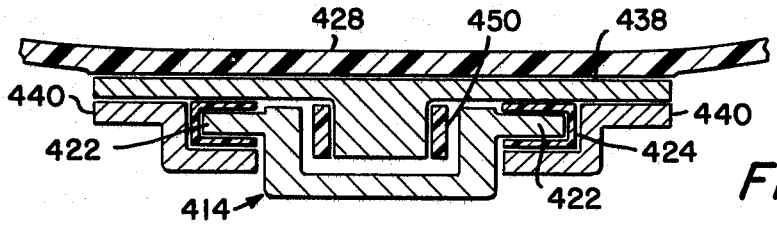
Figure 27:
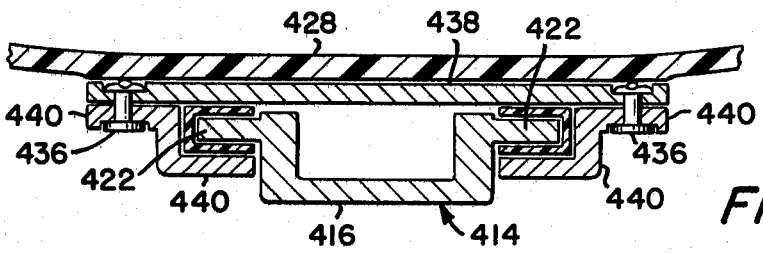
Figure 28:
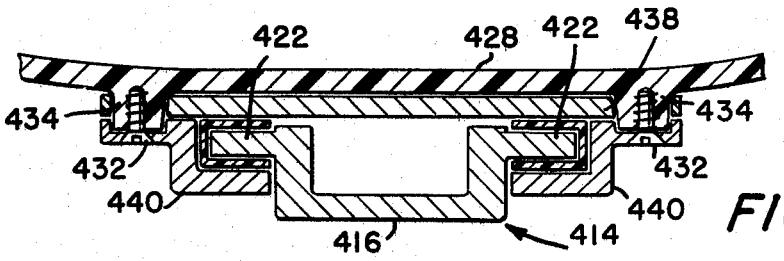

Referring to FIGS. 22 to 28, the seat support unit comprises a main body portion 416 that extends lengthwise of the chair and has a dependent boss 418 that receives the post 420 of the pedestal base 400 (FIGS. 22 and 25). The seat support unit 414 has extending longitudinally along each side and projecting outwardly a pair of laterally spaced-apart seat supports 422, each of which receives an elongated, generally cup-shaped anti-friction bearing element 424, for example, an element made of "Teflon" or nylon. The seat supports 422 are received in telescoping relation within a pair of laterally spaced-apart sleeves 426 that extend lengthwise under the chair seat 428, the sleeves being defined by a mounting unit 430 which is fastened, such as by screws 432 (FIG. 28), to bosses 434 molded on the under side of the seat 428. The mounting unit 430 is assembled, such as by rivets 436 (FIG. 27), from a plate 438 which abuts the underside of the seat 428 and a pair of elongated members 440 of generally "Z"-shaped cross-section. The sleeves 426 defined by the plate 438 and the members 440 receive telescopically the seat supports 422 with a clearance adequate to permit the seat to slide relatively freely backward and forward on the seat supports.

The seat 428 is spring-loaded toward the rearwardmost position (the position shown in FIGS. 22 to 28) by a coil spring 442 connected under tension between a pin 444 that extends up into a cavity 446 formed in the body portion 416 of the seat support unit 414 and a pin 448 that projects down into the cavity 446 from the plate 438 of the mounting unit 430. The limit position of backward movement of the seat 428 is established by engagement of rubber bumper 450 that is mounted on a rib 452 extending down from the underside of the plate 438 into the cavity 446 with a pair of ribs 454 on the body portion 416 of the seat support unit that project into the cavity 446. The forward limit position is established by engagement of the rubber bumper 450 with the front wall 456 of the body portion 416.

Figure 29:
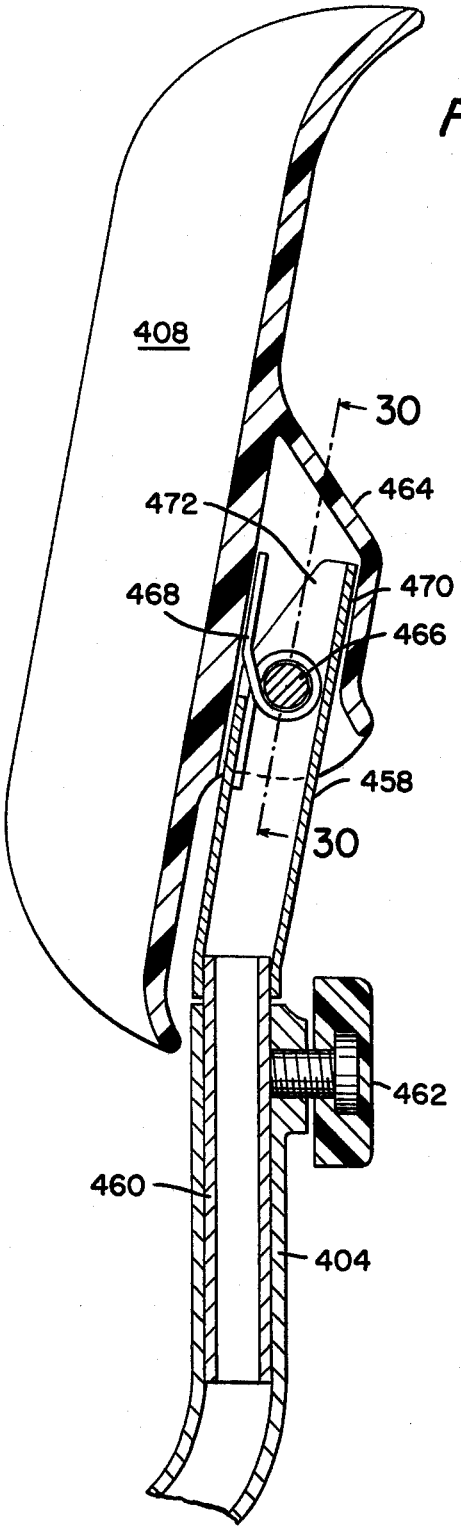
FIG. 29 is a side cross-sectional view of the back of the chair of FIGS. 20 and 21 taken generally along the lines 29—29 of FIG. 21 and in the direction of the arrows.
Figure 30:
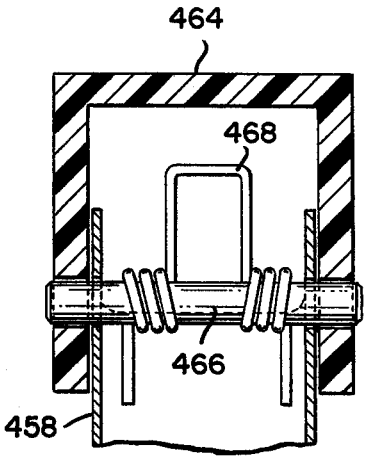
FIG. 30 is a fragmentary, cross-sectional view of the back mounting structure taken along the lines 30—30 of FIG. 29 and in the direction of the arrows.

As best shown in FIGS. 29 and 30, the back 408 of the chair of FIGS. 20 to 30 is mounted on an extension 458 of the back support portion 404 by means of a coupling 460 that is received telescopically in the back support portion 404 with a clearance that permits it to be slided up and down to adjust the height of the back 408. The back is locked at the desired height by a lock screw 462.

The extension 458 is received in a sleeve 464 molded into the back wall of the chair back 408, and the back 408 is mounted to tilt between the relatively upright position shown in FIG. 29 and an inclined position (not shown) by a pivot coupling that is provided by an axle 466 that extends through holes in the extension 458 and in the sleeve 464. The back is spring-loaded into the relatively upright position by a torsion spring 468 of generally the mousetrap type. The forward or upright limit position of tilting of the back 408 is established by engagement between the upper part of the back face of the extension 458 and the inside face of the back wall of the sleeve 464 in the region marked by the numeral 470 and by engagement between the upper end of the front face of the extension 458 and the part of the back face of the chair back 408 adjacent thereto (see FIG. 29). The rearward or inclined limit position of tilting of the back 408 is established by engagement of the part of the back of the chair within the sleeve 464 with the upper edges 472 of the side walls of the extension 458, which are cut at an angle to provide the desired limit of tilting of the back. The lower end of the back wall of the sleeve 464 angles away from the extension 458 to accommodate rearward tilting of the back and may engage the back wall of the extension 458, further to assist in supporting the back at the limit of inclined tilting.

All of the chairs described above and shown in the drawings share the common principle of independent forward and backward movement of the seat and tilting of the back such that the chair will automatically adopt a configuration that will provide excellent anatomical support to a person sitting in the chair. The chair provides optimal distribution of body weight and excellent sacro-lumbar support in all configurations. When a person sitting in the chair sits upright, the seat will be in the rearward position and the back in an upright position. When the person wants to lean back into a relaxed position in the chair, the seat will slide forward and the back will incline, such adjustments in the configuration of the chair being substantially solely responsive to the sitting posture of the individual. Except in those cases when the seat is heavily padded, the increased rake of the seat plays an important role in supporting the body properly when the person relaxes back in the chair.

The above-described embodiments of the invention are intended to be merely exemplary and numerous variations and modifications may be made without departing from the spirit and scope of the invention. All such variations and modifications are intended to be included within the scope of the invention as defined in the appended claims.

I claim:

1. A chair comprising a frame that includes at least one back support, a seat-supporting structure, and means rigidly connecting the back support to the seat-supporting structure; a back mounted on the back support, and a seat mounted on the seat-supporting structure, the seat-supporting structure including at least one elongated member that extends lengthwise of the chair under the seat and has an elongated front portion rigidly supported from the rear in cantilevered relation to the remainder of the chair frame, the at least one elongated member having thereon laterally spaced-apart parallel elongated seat supports, the seat supports being of substantially uniform external cross-section throughout their lengths and having axes extending lengthwise of the chair in substantially parallel vertical planes, and the seat having a pair of laterally spaced-apart elongated sleeves, each of which is of substantially uniform internal cross-section along its length, is substantially coextensive with a corresponding seat support, and receives a corresponding one of the seat supports in sliding relation therein, such that the seat is slidable backward and forward on the seat supports, means resiliently urging the seat to its rearward limit position on the seat support, coacting means on the seat and the seat supports for limiting the extent of movement of the seat on the seat supports, and means mounting the back on the back support for tilting movement independently of movement of the seat about a substantially horizontal transverse axis and resiliently urging the back about said axis to a relatively upright position.

2. A chair according to claim 1 wherein the axes of the seat supports and the axes of the sleeves on the seat are coincident and are upwardly concavely arcuate such that the seat has an increased rake the farther forward it is on the seat supports.

3. A chair according to claim 1 wherein the seat supports are tubular and the urging means includes a spring means received within each seat support and coupled between the seat support and the seat.

4. A chair according to claim 3 wherein the urging means includes a mechanical spring means having a first portion coupled to the seat support and a second portion spaced from the first coupled to a link, and wherein the limiting means includes as a forward limit a formation on the link engageable with a member fixedly associated with the seat support.

5. A chair supporting to claim 4 wherein the limit means includes as the rearward limit co-engageable portions fixedly associated, respectively, with the seat sleeves and the forward ends of the seat supports.

6. A chair according to claim 1 wherein the mounting means includes an articulating structure having a first part secured to the upper end of the back support and a second part secured to the back.

7. A chair according to claim 6 wherein the back includes a socket and wherein the second part of the articulating structure is received within the socket.

8. A chair according to claim 7 wherein the back support is tubular and the first part of the articulating structure is received telescopically within the back support.

9. A chair according to claim 6 wherein the first and second parts of the articulating structure are separate and are joined for relative articulation and wherein the back-mounting means further includes spring means resiliently biasing the first and second parts into a predetermined relation to each other.

10. A chair according to claim 9 wherein the articulating structure includes a first part secured to the back support, a second part secured to the back, a link coupled for articulation to one of the first and second parts of the structure and resiliently coupled to the other part to urge co-engaging surfaces on the parts into engagement while affording articulation between the parts.

11. A chair according to claim 9 wherein the two parts are coupled by a pin for articulation and one of the parts of the articulating structure is hollow and wherein the other part has a portion extending into the hollow part and wherein the structure further includes resilient means engaged between said portion and the hollow part to urge the parts into said predetermined relation to each other while affording articulation between them.

12. A chair according to claim 8 wherein the first and second parts are portions of a unitary member.

13. A chair according to claim 12 wherein the member is made of an inherently resilient material.

14. A chair according to claim 6 wherein the articulating structure includes means limiting the extent of tilting movement of the back.

15. A chair according to claim 13 wherein the articulating structure includes means coacting with the member for controlling and limiting the flexure thereof.

16. A chair according to claim 15 wherein the coacting means is a stack of tapered rings surrounding a medial portion of the member and engaged between surfaces of the sleeves and back supports, respectively.

17. A chair according to claim 12 wherein the articulating structure further includes at least one leaf spring extending through the member.

18. A chair according to claim 1 wherein the mounting means includes an axle coupling the back to the back support for pivotal movement of the back.

19. A chair according to claim 18 wherein the back has a sleeve that receives the upper end of the back support and wherein the sleeve and the back support have interengaging surfaces that limit the extent of pivotal movement of the back.

20. A chair according to claim 18 wherein the mounting means includes a torsion spring associated with the axle and coacting between the back and back support.

21. A chair comprising a frame that includes a pair of laterally spaced-apart members, each such member including a back-supporting portion and a seat-supporting portion, the seat-supporting portion of each of the members having an axis lying in a vertical plane parallel to the lengthwise axis of the chair and having an elongated front part supported solely from the rear in cantilevered relation, a back mounted on the back-supporting portions for tilting movement, and a seat mounted on the seat-supporting portions for sliding movement by means of elongated spaced-apart sleeves thereon, each of which is substantially coextensive with and receives telescopically the seat-supporting portion of one of the members.

22. A chair according to claim 21 wherein the frame further includes a beam-like transverse member under the seat and the said spaced-apart members are rigidly connected to the transverse member and further comprising legs rigidly attached to the transverse member and supporting the transverse member and the seat-supporting portions of the said spaced-apart member at substantially the height of a chair seat.

23. A chair according to claim 22 wherein the said spaced-apart members of the frame are connected adjacent the respective ends of beam-like member.

24. A chair according to claim 22 wherein the said spaced-apart members are connected to the beam-like member substantially inwardly from the ends of the beam-like member.

25. A chair according to claim 22 wherein the legs are portions of two inverted generally "V"-shaped members, one of which is attached adjacent each end of the beam-like member at the apex thereof.

26. A chair according to claim 22 wherein the legs are portions of two inverted generally "U"-shaped members joined at each other at an angle along at least a portion of the cross-portions thereof, such joined crossing portions constituting the beam-like member of the chair frame.

27. A chair comprising a frame having a back support and a member connected rigidly to the back support, said member having a pair of laterally spaced-apart elongated seat supports joined thereto, the seat supports having axes lying in parallel planes extending vertically and lengthwise of the chair, and said member having an elongated front part supported solely from the rear in cantilevered relation, a back mounted on the back support for tiling movement, and a seat mounted on the seat supports of said member by means of spaced-apart sleeves thereon, each of which is substantially coextensive with and receives telescopically one of said seat supports of said member for lengthwise sliding movement of the seat on the seat supports.

28. A chair comprising a back, a back support, means mounting the back on the back support for tilting movement, a seat having a pair of laterally spaced-apart elongated substantially parallel sleeves arranged lengthwise of the seat, and a seat-supporting structure rigidly connected to the back support and having a pair of laterally spaced-apart parallel seat supports extending lengthwise of the chair and having elongated front parts supported solely from the rear in cantilevered relation and telescopically received in the sleeves for sliding movement therein such that the seat is slidable forward and backward relative to the chair back, the back tilting independently of sliding movement of the seat in accordance with the sitting posture and physical form of a person sitting in the chair.

29. A chair comprising a frame including a pair of unitary members, each of which has a seat-supporting portion and a back-supporting portion, and means rigidly connecting the members to each other in laterally spaced relation, a seat mounted on the seat-supporting portions of the members for movement backward and forward thereon, a back mounted on the back-supporting portions of the members and a flexible, extensible tube received on each member and joined on one end to the back and at the other end to the seat, each tube extending and retracting as the seat is moved forward and backward.

30. A chair according to claim 29 wherein the seat includes a pair of laterally-spaced apart sleeves, each of which telescopically receives a corresponding seat-supporting portion of a frame member for sliding movement of the seat thereon, each sleeve having a terminal rearwardly located annular flange telescopically received within the end of the corresponding tube.

31. A chair according to claim 29 wherein the back is mounted on the back-supporting portion of the respective frame members by a resilient articulating coupling, the back including a pair of spaced-apart sleeves receiving a part of the coupling and each sleeve terminating in an annular flange and the annular flange being telescopically received within the end of the corresponding tube.

32. A chair according to claim 29 wherein each frame member is generally "L"-shaped in elevation, the seat-supporting portion being one leg of the "L" and the back-supporting portion being another leg of the "L".

33. A chair according to claim 29 wherein each frame member is generally "Z"-shaped in elevation, the top leg of the "Z" being an armrest and the bottom leg of the "Z" being the seat-supporting portion and wherein the back is supported from the free end of the top leg of the "Z".

34. A chair comprising a frame having at least one back support, a pair of laterally spaced-apart seat supports and means rigidly connecting the supports, a back mounted on the back support for tilting movement from a resiliently restrained relatively upright position, a seat mounted on the seat supports, the seat supports being of substantially uniform external cross-section throughout their lengths and having axes extending lengthwise of the chair in substantially parallel vertical planes, and the seat having on its underside a pair of laterally spaced-apart elongated sleeves, each of which is attached to and extends continuously along a substantial part of the seat to impart strength and rigidity thereto and is of substantially uniform internal cross-section along its length and is substantially coextensive with and receives one of the seat supports in sliding relation therein such that the seat is slidable forward on the seat supports.

35. A chair comprising a frame having at least one back support and at least one seat support, a seat mounted on the seat support of the frame for backward and forward movement, a back, and means mounting the back on the back support for tilting movement about a substantially horizontal transverse axis and resiliently urging the back into a relatively upright position, said mounting means including an articulating structure having a first part secured to the back support, a second part secured to the back, and an elongated link coupled for articulation to one of the parts of the structure and resiliently coupled to the other part to urge co-engaging surfaces on the parts into engagement while affording articulation between the parts.

36. A chair according to claim 35 wherein: (a) at least the upper end of the back support is tubular and receives telescopically one of the parts of the articulating structure, (b) the back includes a socket which is open generally downwardly to face the upper end of the back support and receives the other part of the articulating structure, (c) the co-engaging surface of the parts of the articulating structure consist of a rib on one part and a groove on the other part receiving the rib, (d) the link has one end secured for pivotal movement to one of the parts of the articulating structure and extends through a cavity in the other part and (e) a spring is engaged under compression between said other part and the end of the link opposite from the end secured to the first part of the articulating structure.

* * * * *